US011837808B2

(12) United States Patent
Maesoba et al.

(10) Patent No.: US 11,837,808 B2
(45) Date of Patent: Dec. 5, 2023

(54) BOARD CONNECTOR AND DEVICE

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 239 days.

(21) Appl. No.: 17/418,535

(22) PCT Filed: Dec. 25, 2019

(86) PCT No.: PCT/JP2019/050875
§ 371 (c)(1),
(2) Date: Jun. 25, 2021

(87) PCT Pub. No.: WO2020/138191
PCT Pub. Date: Jul. 2, 2020

(65) Prior Publication Data

US 2022/0102885 A1 Mar. 31, 2022

(30) Foreign Application Priority Data

Dec. 28, 2018 (JP) ..... 2018-247604
Aug. 5, 2019 (JP) ..... 2019-143489

(51) Int. Cl.
*H01R 13/627* (2006.01)
*H01R 12/71* (2011.01)
*H01R 13/424* (2006.01)

(52) U.S. Cl.
CPC ..... *H01R 12/716* (2013.01); *H01R 13/424* (2013.01)

(58) Field of Classification Search
CPC .. H01R 12/716; H01R 13/424; H01R 13/506; H01R 13/6272; H01R 24/50; H01R 13/6594
See application file for complete search history.

(56) References Cited

U.S. PATENT DOCUMENTS 4,640,566 A * 2/1987 Matsusaka ..... H01R 13/6272 439/350
4,889,503 A * 12/1989 Philippson ..... H01R 12/716 439/607.45

(Continued)

FOREIGN PATENT DOCUMENTS

JP H05-023461 U 3/1993
JP 2008-059761 A 3/2008

(Continued)

OTHER PUBLICATIONS

International Search Report dated Mar. 17, 2020 for WO 2020/138191 A1 (4 pages).

*Primary Examiner* — Abdullah A Riyami
*Assistant Examiner* — Nelson R. Burgos-Guntin
(74) *Attorney, Agent, or Firm* — Venjuris, P.C.

(57) ABSTRACT

A board connector 10 to be mounted on a circuit board 50 is provided with a connector housing 11 including a receptacle 15 and a back wall 30 provided on a side opposite to an opening direction of the receptacle 15, a mating connector 70 being fit into the receptacle 15, an outer conductor 20 disposed in an outer conductor mounting hole 34 formed to (Continued)

penetrate through the back wall 30, an insulating dielectric 19 disposed inside the outer conductor 20, and an inner conductor 18 disposed inside the dielectric 19. The outer conductor 20 includes a closing portion 25 for closing a mold removal hole 32 formed at a position of the back wall 30 different from the outer conductor mounting hole 34.

6 Claims, 16 Drawing Sheets

(56) References Cited

U.S. PATENT DOCUMENTS 5,190,461 A * 3/1993 Oorui ..... H01R 24/50 439/74
5,234,353 A * 8/1993 Scholz ..... H01R 24/50 439/291
5,244,412 A * 9/1993 Hatch ..... H01R 12/716 439/571
5,344,335 A * 9/1994 Scholz ..... H01R 13/28 439/357
5,679,009 A * 10/1997 Okumura ..... H01R 12/7005 439/573
5,913,703 A * 6/1999 Suzuki ..... H01R 13/641 439/701
6,315,603 B1 * 11/2001 Miura ..... H01R 12/774 439/495
6,503,108 B1 * 1/2003 Kikuchi ..... H01R 13/645 439/594
9,882,303 B1 * 1/2018 Chalas ..... H01R 13/424
10,396,481 B2 * 8/2019 Lauermann ..... H01R 12/716
2001/0026049 A1 * 10/2001 Ichida ..... H01R 13/5219 277/608
2003/0171032 A1 * 9/2003 Kobayashi ..... H01R 12/00 174/359
2003/0194899 A1 * 10/2003 Ueda ..... H01R 13/6272 439/357
2004/0023564 A1 * 2/2004 Yamamoto ..... H01R 13/6272 439/701
2005/0247476 A1 * 11/2005 Aihara ..... H01R 13/6272 439/595
2006/0160429 A1 * 7/2006 Dawiedczyk ..... H01R 12/727 439/676
2006/0228932 A1 * 10/2006 Komiyama ..... H01R 13/514 439/467
2007/0281555 A1 * 12/2007 Suemitsu ..... H01R 13/424 439/752
2009/0269988 A1 * 10/2009 Zhuang ..... H01R 24/64 439/676
2014/0024262 A1 * 1/2014 Okamoto ..... H01R 13/518 439/658
2014/0302692 A1 * 10/2014 Raff ..... H01R 12/716 439/65
2015/0038018 A1 * 2/2015 Matsuzawa ..... H01R 13/518 439/638
2015/0207246 A1 * 7/2015 Lewis ..... H01R 12/721 439/62
2015/0318643 A1 * 11/2015 Lane ..... H01R 12/716 439/607.35
2016/0322770 A1 * 11/2016 Zerebilov ..... H01R 43/26
2017/0005434 A1 * 1/2017 Taguchi ..... H01R 13/4223
2017/0285666 A1 * 10/2017 Ohtani ..... H05K 1/181
2017/0288334 A1 * 10/2017 Moriyasu ..... H01R 24/20
2017/0331230 A1 * 11/2017 Bayer ..... H01R 13/629
2018/0183168 A1 * 6/2018 Sugaya ..... H01R 12/716
2018/0233853 A1 * 8/2018 Janowiak ..... H01R 13/6594
2018/0366844 A1 * 12/2018 Beganovic ..... H01R 24/50
2019/0044276 A1 * 2/2019 Maesoba ..... H01R 13/5221
2019/0109408 A1 * 4/2019 Maddens ..... H01R 43/26
2019/0267748 A1 * 8/2019 Kawahara ..... H01R 25/003
2020/0028293 A1 * 1/2020 Behrendt ..... H01R 12/91
2020/0028295 A1 * 1/2020 Soubh ..... H01R 13/4223
2020/0091654 A1 * 3/2020 Miyamoto ..... H01R 13/6275
2020/0295511 A1 * 9/2020 Shioda ..... H01R 12/91

FOREIGN PATENT DOCUMENTS

JP 2009-066858 A 4/2009
JP 2009-277544 A 11/2009
JP 2016-143648 A 8/2016

* cited by examiner

BOARD CONNECTOR AND DEVICE

CROSS REFERENCE TO RELATED APPLICATIONS

This application is a national phase of PCT application No. PCT/JP2019/050875, filed on 25 Dec. 2019, which claims priority from Japanese patent application Nos. 2018-247604 and 2019-143489 filed on 28 Dec. 2018 and 5 Aug. 2019, respectively, all of which are incorporated herein by reference.

TECHNICAL FIELD

A technique disclosed in this specification relates to a technique relating to a board connector to be disposed on a circuit board.

BACKGROUND

Conventionally, a board connector is known from Japanese Patent Laid-open Publication No. 2008-059761. This connector includes an inner conductor to be connected to a conductive path formed on the circuit board, an insulating dielectric for surrounding the inner conductor, an outer conductor for surrounding the dielectric and a connector housing for accommodating the inner conductor, the dielectric and the outer conductor.

By surrounding the inner conductor connected to the conductive path of the circuit board by the outer conductor, noise entering the inner conductor from outside the board connector is suppressed and noise leaking to the outside of the board connector from the inner conductor is also suppressed.

PRIOR ART DOCUMENT

Patent Document

Patent Document 1: JP 2008-059761 A

SUMMARY OF THE INVENTION

Problems to be Solved

The above connector includes a receptacle into which a mating connector is fit. A stopper to be locked to the mating connector is formed to project inwardly of the receptacle on an opening end part of the receptacle. A mold removal hole for forming the stopper penetrates through a back wall provided on a side opposite to the opening end part of the receptacle. Thus, there is a concern that noise generated from the circuit board leaks to the outside of the board connector through the mold removal hole of the connector housing.

The technique disclosed in this specification was completed on the basis of the above situation and aims to provide a technique relating to a board connector with improved shielding performance.

Means to Solve the Problem

The technique disclosed in this specification is directed to a board connector to be mounted on a circuit board, the board connector including a connector housing having a receptacle and a back wall provided on a side opposite to an opening direction of the receptacle, a mating connector being fit into the receptacle, an outer conductor inserted in an outer conductor mounting hole penetrating through the back wall, an insulating dielectric disposed inside the outer conductor, and an inner conductor disposed inside the dielectric, the outer conductor including a closing portion for closing a through hole formed at a position of the back wall different from the outer conductor mounting hole.

According to the above configuration, since the through hole formed in the connector housing is closed by the closing portion of the outer conductor, the leakage of noise generated from the circuit board to outside through the through hole of the board connector can be suppressed. In this way, the shielding performance of the board connector can be improved. The noise generated from the circuit board includes noise generated from conductive paths formed in the circuit board and noise generated from an electronic component mounted on the circuit board.

The following modes are preferable as embodiments of the technique disclosed in this specification.

The outer conductor includes a tubular portion extending along the opening direction and configured to accommodate at least a part of the inner conductor, and a flange projecting outward is provided on an outer periphery of the tubular portion and provided with the closing portion.

According to the above configuration, the connector housing and the outer conductor can be easily aligned in the opening direction by bringing the flange into contact with the back wall of the connector housing.

Further, the through hole of the back wall can be reliably closed by bringing the back wall of the connector housing and the flange into contact.

The connector housing and the outer conductor are positioned by fitting a locking projection provided on one of the back wall and the flange and a locking recess provided in the other.

According to the above configuration, the connector housing and the outer conductor can be reliably positioned.

The locking recess is provided in the flange, the locking recess includes a small-diameter portion on the back wall side and a large-diameter portion provided on a side opposite to the back wall and having a larger diameter than the small-diameter portion, and the locking projection is filled in the locking recess.

According to the above configuration, the connector housing and the flange are fixed by the contact of the locking projection filled in the locking recess with a boundary part between the large-diameter portion and the small-diameter portion in the locking recess from the side opposite to the back wall. Since position shifts of the connector housing and the outer conductor can be suppressed in this way, the shielding performance of the board connector can be improved.

The large-diameter portion has a tapered surface expanded in diameter with distance from the back wall.

By forming the tapered surface in the large-diameter portion, the locking projection filled in the locking recess is more easily held in close contact with an inner wall of the locking recess. In this way, the connector housing and the outer conductor can be more firmly fixed.

The technique disclosed in this specification is also directed to a device with the above board connector, a circuit board having the board connector mounted thereon, and a case made of metal for accommodating the circuit board, the case being electrically connected to the outer conductor.

According to the above configuration, since the case made of metal is electrically connected to the outer conductor, the leakage of noise generated from the circuit board accommodated in the case to outside can be reliably suppressed.

Effect of the Invention

According to the technique disclosed in this specification, it is possible to suppress the shielding performance of a board connector.

DETAILED DESCRIPTION TO EXECUTE THE INVENTION

First Embodiment

A first embodiment of the technique disclosed in this specification is described with reference to FIGS. 1 to 9. A board connector 10 according to this embodiment is to be mounted on a circuit board 50 accommodated inside a device 60. In the following description, a Z direction indicates an upward direction, a Y direction indicates a forward direction and an X direction indicates a leftward direction. Further, only some of a plurality of identical members may be denoted by a reference sign and the other members may not be denoted by the reference sign.

[Device 60]

Figure 1:
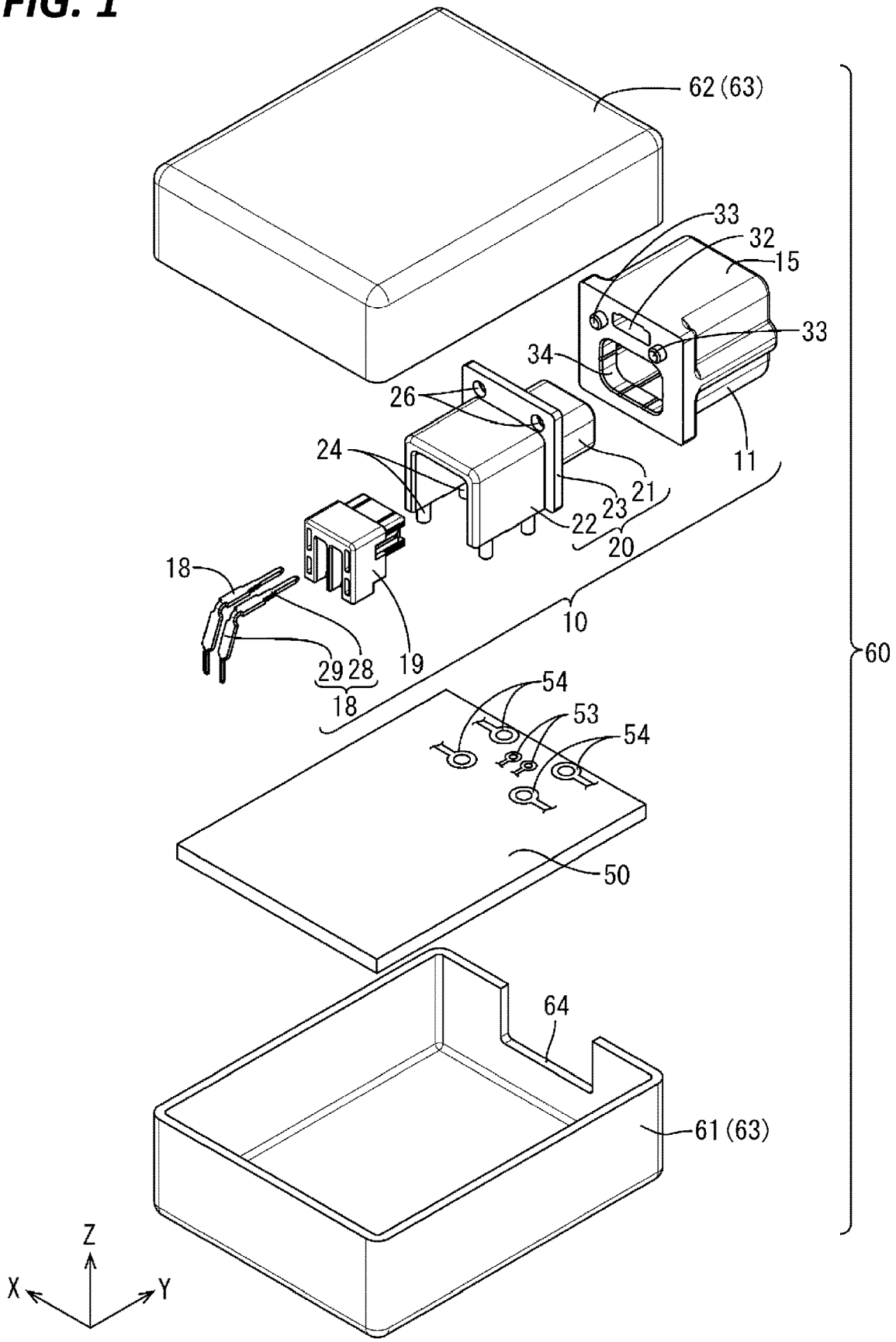
FIG. 1 is an exploded perspective view showing a device according to a first embodiment.
Figure 2:
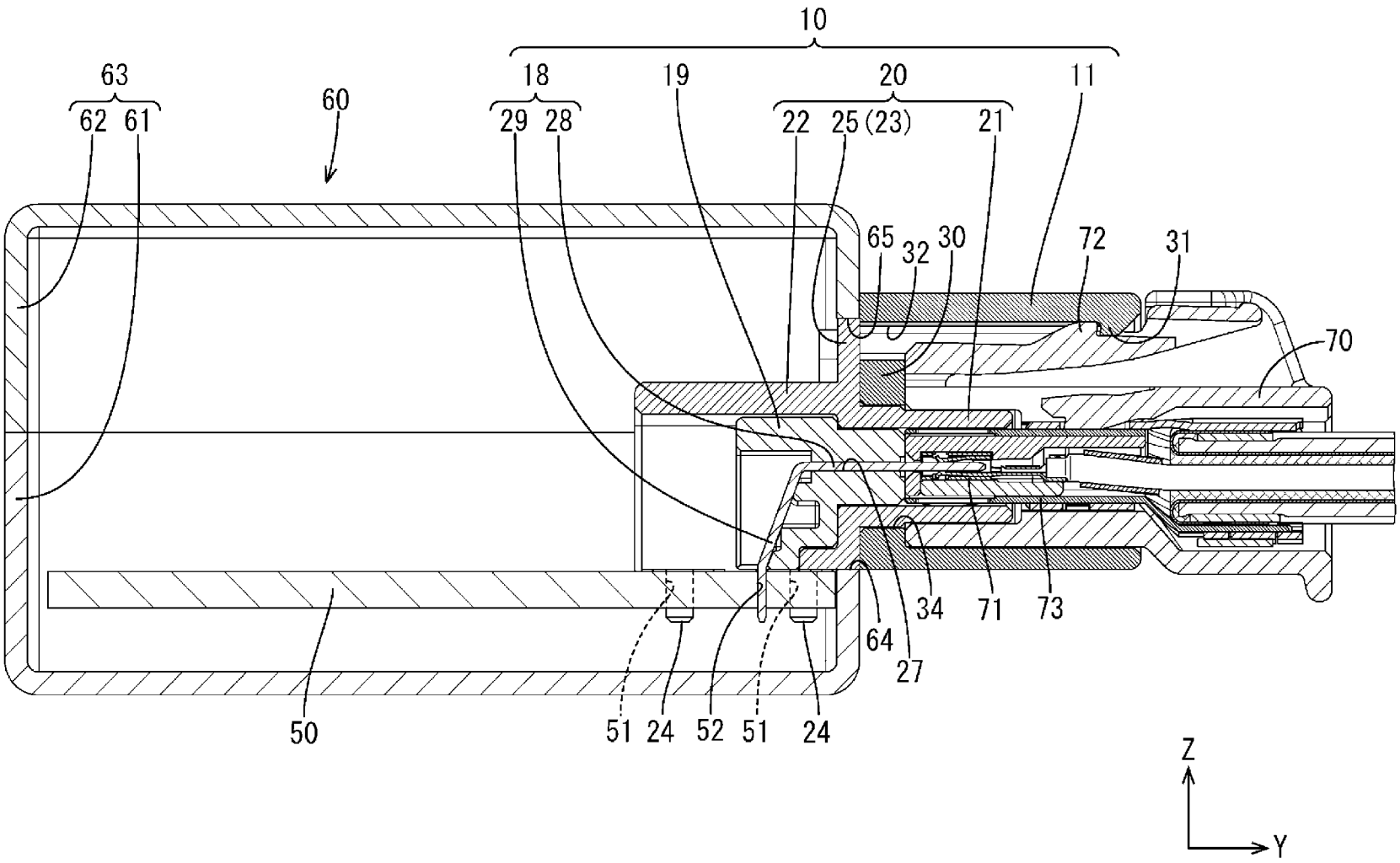
FIG. 2 is a section showing a state where a mating connector is connected to a board connector of the device.

As shown in FIGS. 1 and 2, the device 60 includes a lower case 61 in the form of a box open upward and an upper case 62 for closing an opening of the lower case 61 by being assembled with the lower case 61 from above. The lower case 61 and the upper case 62 are made of conductive metal. The lower case 61 and the upper case 62 are integrally assembled by a known method such as screwing or a locking structure, whereby a case 63 is formed. The case 63 is in the form of a rectangular parallelepiped as a whole.

A lower recess 64 recessed downward is formed in the upper end edge of the front wall of the lower case 61. An upper recess 65 cut upward at a position corresponding to the lower recess 64 of the lower case 61 in a state assembled with the lower case 61 is formed in the lower end edge of the front wall of the upper case 62. With the lower case 61 and the upper case 62 assembled, the board connector 10 is assembled in a space formed by the lower recess 64 and the upper recess 65.

The circuit board 50 is accommodated in the case 63. The board connector 50 is fixed to the case 63 by a known method such as screwing. Signal conductive paths 53 for signal in which signals are transmitted and ground conductive paths 54 are formed on the circuit board 50 by a known printed wiring technique. A plurality of (four in this embodiment) outer conductor through holes 51 and a plurality of (two in this embodiment) inner conductor through holes 52 are formed to penetrate through the circuit board 50 in a vertical direction at positions near a front end part of the circuit board 50. Conductive paths (not shown) formed by plating or the like are formed on the inner surfaces of the outer conductor through holes 51 and the inner surfaces of the inner conductor through holes 52. The conductive paths formed on the inner surfaces of the outer conductor through holes 51 are electrically connected to the ground conductive paths 54. Further, the conductive paths formed on the inner surfaces of the inner conductor through holes 52 are electrically connected to the signal conductive paths 53. An unillustrated electronic component is connected to the signal conductive paths 53 and the ground conductive paths 54 on the circuit board 50 by a known method such as soldering.

[Board Connector 10]

As shown in FIG. 2, the board connector 10 includes a connector housing 11 to be mounted on the circuit board 50, an outer conductor 20 to be mounted into the connector housing 11, a dielectric 19 to be accommodated into the outer conductor 20 and inner conductors 18 to be accommodated into the dielectric 19.

[Connector Housing 11]

Figure 3:
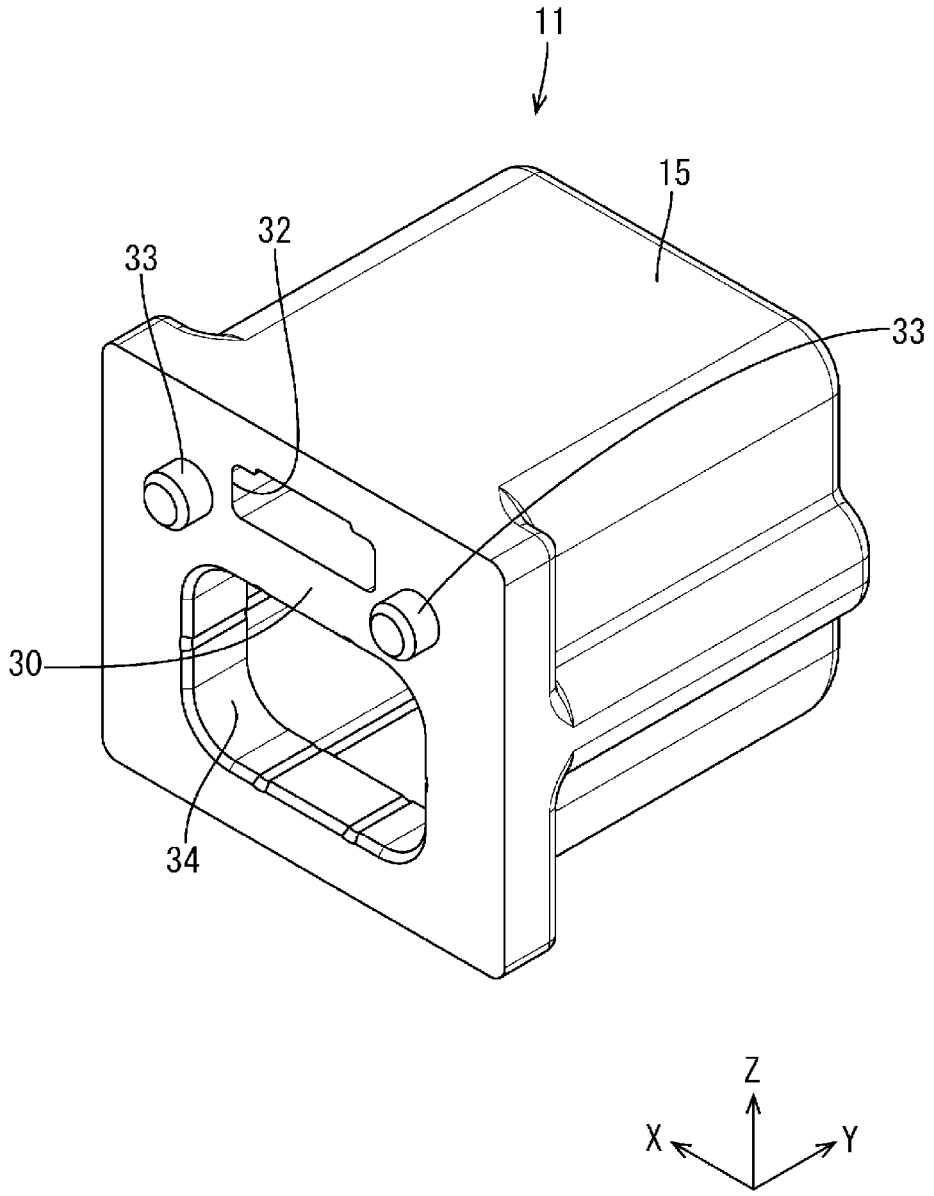
FIG. 3 is a perspective view showing a connector housing.
Figure 9:
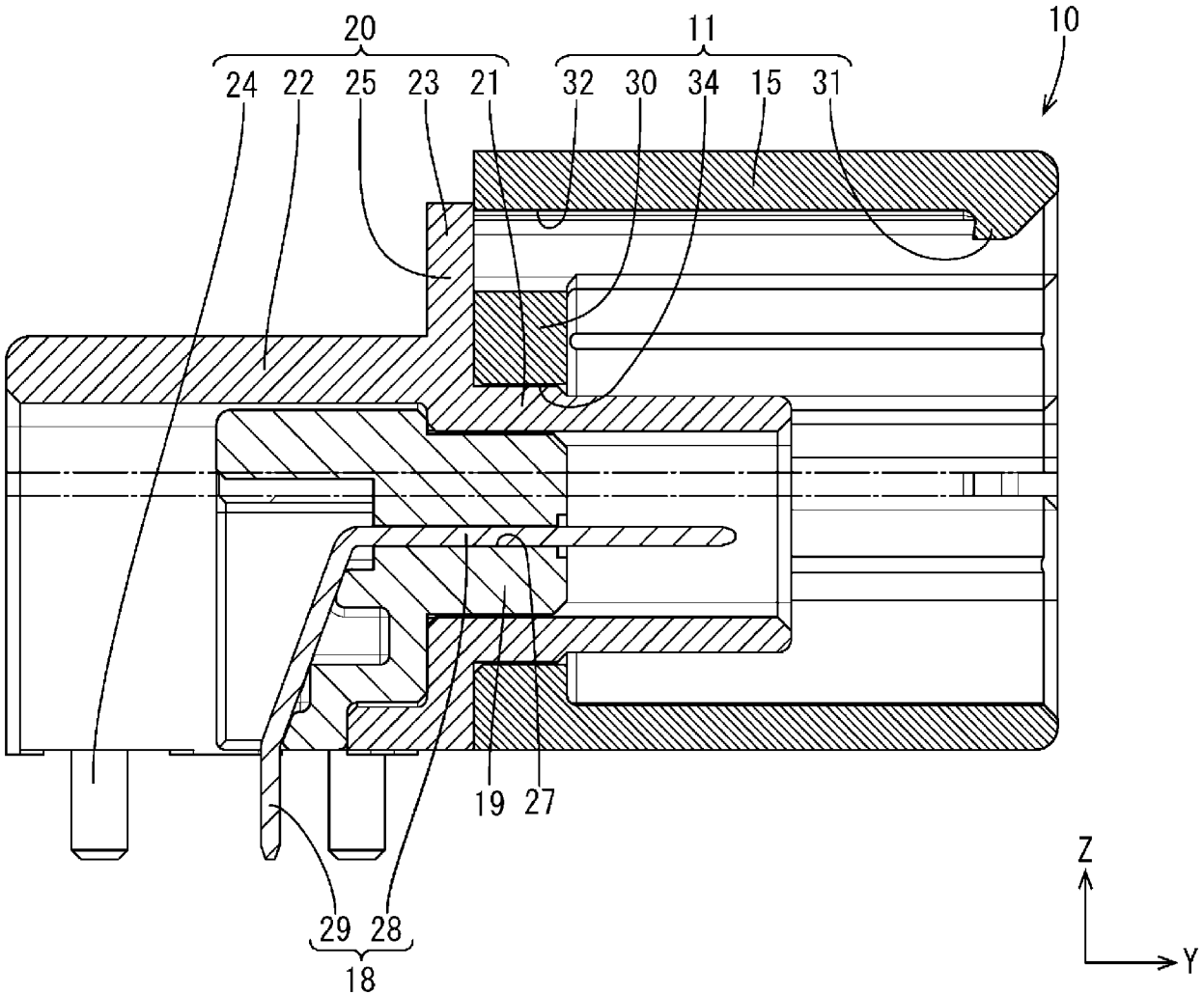
FIG. 9 is a section along IX-IX in FIG. 8.

As shown in FIGS. 3 and 9, the connector housing 11 is formed by injection-molding an insulating synthetic resin. The connector housing 11 includes a receptacle 15 which is open forward (an example of an opening direction) and into which a mating connector 70 is to be fit. A back wall 30 is provided on a side of the connector housing 11 opposite to an opening end part of the receptacle 15. A lock portion 31 projecting downward is formed to project downward on the front end edge (opening end part) of the upper wall of the receptacle 15. As shown in FIG. 2, the lock portion 31 is engaged with a lock arm 72 of the mating connector 70 fit into the receptacle 15, whereby the mating connector 70 is held in the receptacle 15.

A mold removal hole 32 (an example of a through hole) for forming the lock portion 31 in injection-molding the connector housing 11 is formed to penetrate through the back wall 30 in a front-rear direction at a position behind the lock portion 31. Locking projections 33 projecting rearward are formed on both left and right sides of the mold removal hole 32 on an outer surface of the back wall 30. The locking projections 33 are formed into a cylindrical shape (see FIG. 3).

The back wall 30 is formed with an outer conductor mounting hole 34, through which the outer conductor 20 is inserted and which penetrates through the back wall 30 in the front-rear direction, below the mold removal hole 32. The outer conductor mounting hole 34 has a rectangular cross-sectional shape with rounded corners.

[Outer Conductor 20]

Figure 4:
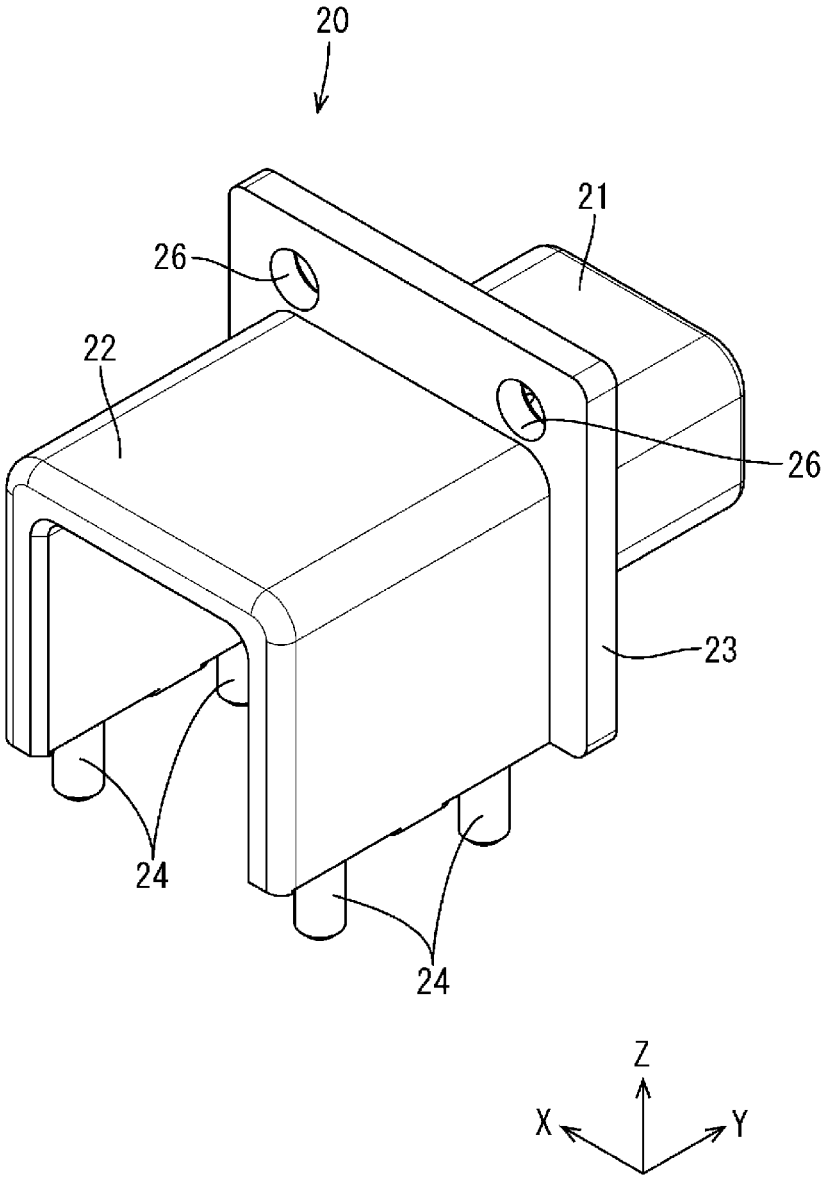
FIG. 4 is a perspective view showing an outer conductor.

The outer conductor 20 shown in FIG. 4 is made of conductive metal. An arbitrary metal such as copper, copper alloy, aluminum or aluminum alloy can be appropriately selected as a metal constituting the outer conductor 20. The outer conductor 20 is formed by a known method such as casting, die casting or cutting. The outer conductor 20 is electrically brought into contact with a mating outer conductor 73 accommodated in the mating connector 70 (see FIG. 2).

The outer conductor 20 includes a tubular portion 21 extending in the front-rear direction and having a tubular shape, a dielectric surrounding portion 22 extending rearward from the rear end edge of the tubular portion 21 and a flange 23 projecting in a direction intersecting the front-rear direction on a boundary part between the tubular portion 21 and the dielectric surrounding portion 22.

The tubular portion 21 has a rectangular cross-sectional shape with rounded corners. The outer shape of the tubular portion 21 is set to be the same as or somewhat smaller than the inner shape of the outer conductor mounting hole 34 of the back wall 30. In this way, the tubular portion 21 is press-fit into the outer conductor mounting hole 34.

The dielectric surrounding portion 22 has a gate shape open downward when viewed from behind. The dielectric 19 is accommodated inside the dielectric surrounding portion 22 while being surrounded on upper, right and left sides by the dielectric surrounding portion 22.

A plurality of (four in this embodiment) cylindrical board connecting portions 24 projecting downward are provided on a lower end part of the dielectric surrounding portion 22. The board connecting portions 24 are passed through the outer conductor through holes 51 of the circuit board 50 and connected to the conductive paths formed on the inner surfaces of the outer conductor through holes 51 by a known method such as soldering. In this way, the outer conductor 20 is electrically connected to the ground conductive paths 54 formed on the circuit board 50.

As shown in FIG. 9, with the tubular portion 21 press-fit in the outer conductor mounting hole 34, the flange 23 is in contact with the rear surface of the back wall 30 from behind. A part of the flange 23 at a position corresponding to the mold removal hole 32 of the back wall 30 serves as a closing portion 25 and closes the mold removal hole 32 from behind.

Figure 7:
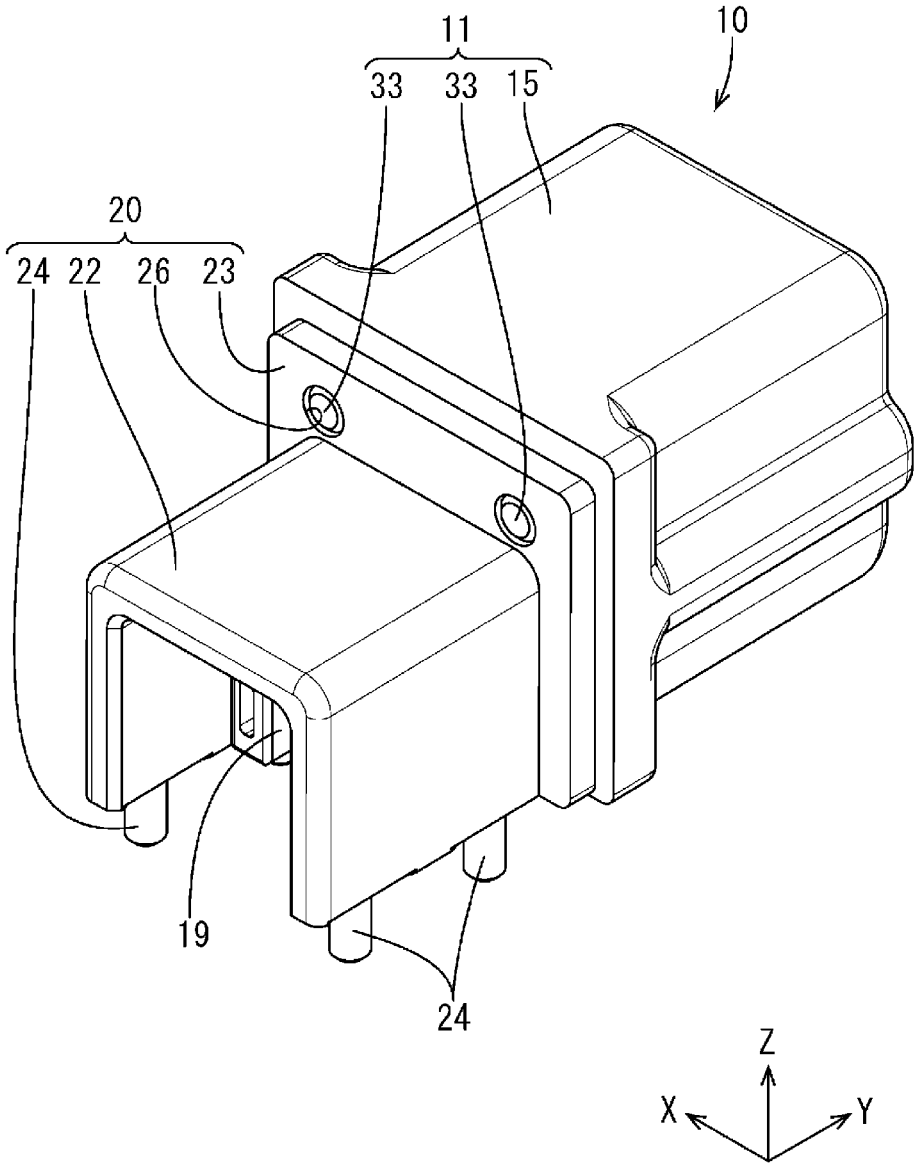
FIG. 7 is a perspective view showing the board connector.
Figure 8:
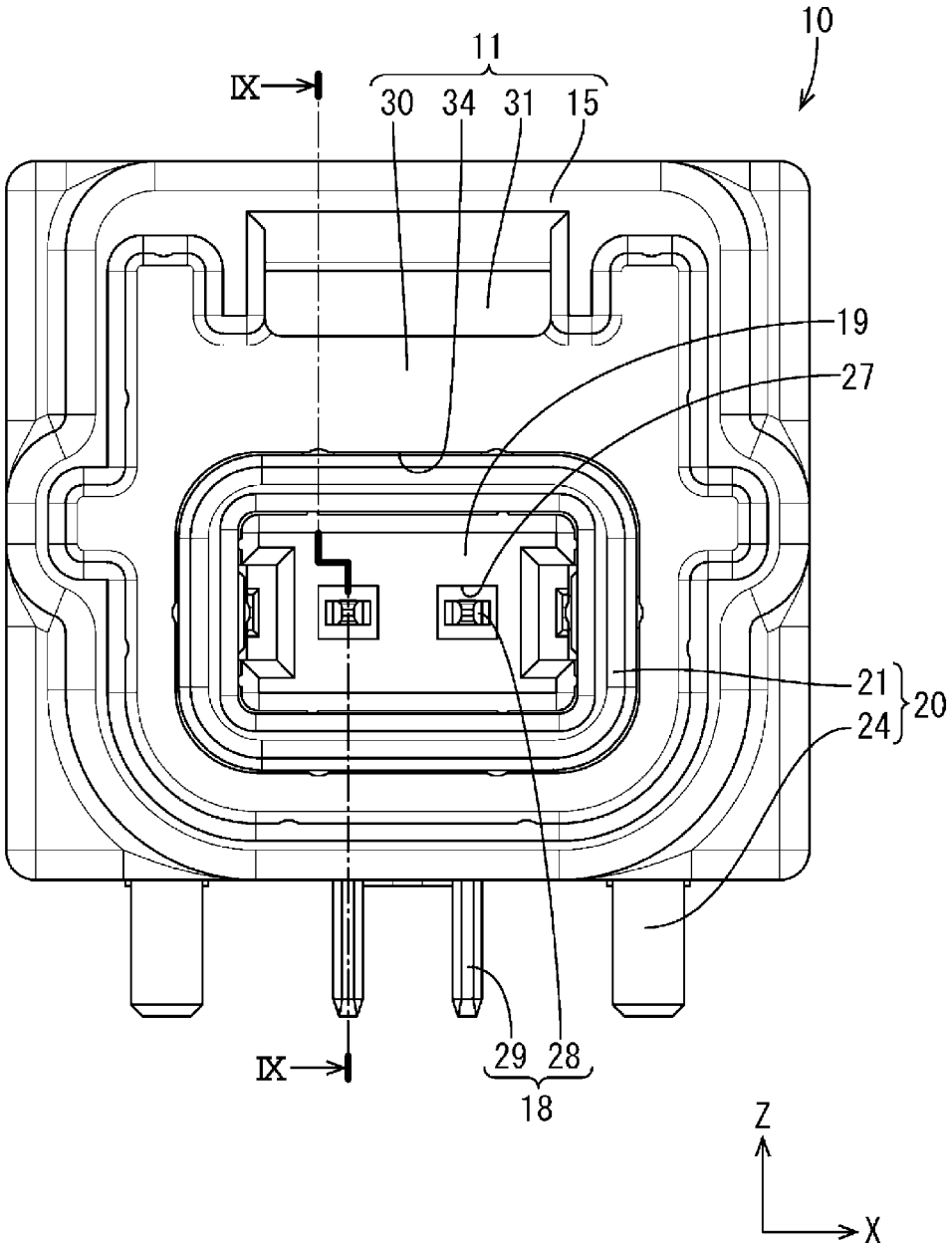
FIG. 8 is a front view showing the board connector.

As shown in FIG. 7, the flange 23 is formed with locking recesses 26 respectively penetrating through the flange 23 in the front-rear direction at positions corresponding to the locking projections 33 of the back wall 30 on both left and right sides of the closing portion 25. The locking recess 26 has a circular cross-sectional shape. The inner shape of the locking recess 26 is set to be substantially the same as the outer shape of the locking projection 33. Substantially same means a case where the both are the same and cases where the both can be certified as substantially equal even if these are different.

[Dielectric 19]

Figure 5:
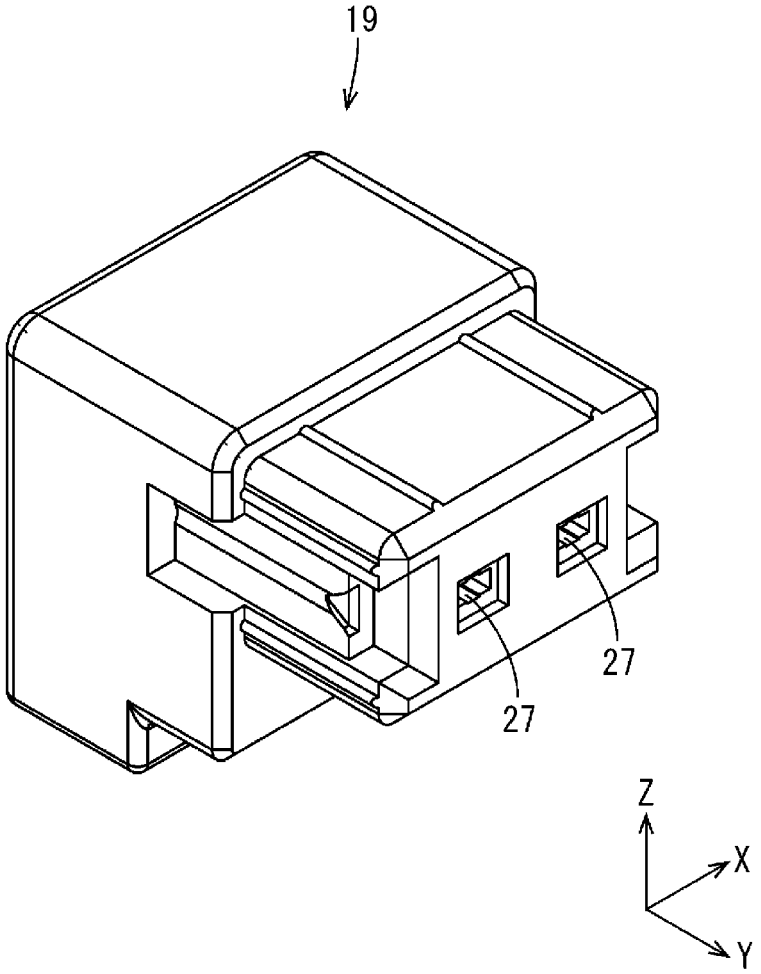
FIG. 5 is a perspective view showing a dielectric.
Figure 6:
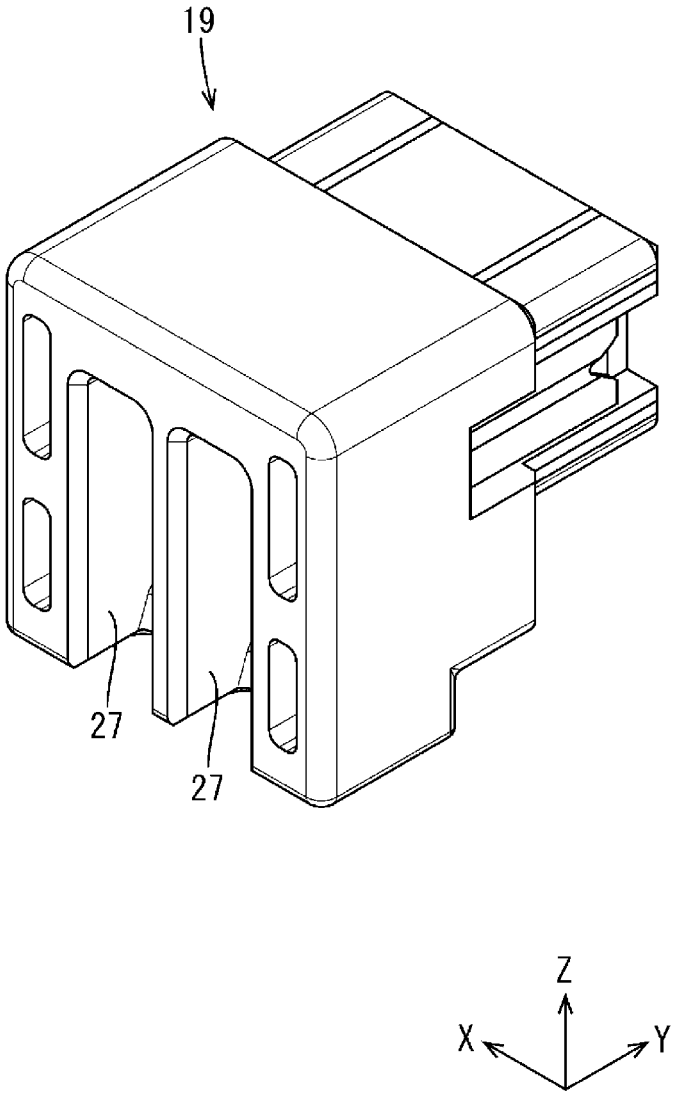
FIG. 6 is a perspective view showing the dielectric when viewed at an angle different from that of FIG. 5.

The dielectric 19 is formed by injection-molding an insulating synthetic resin. As shown in FIGS. 5 and 6, the dielectric 19 is formed to have a substantially L-shaped cross-section. The dielectric 19 includes inner conductor accommodation chambers 27 capable of accommodating the inner conductors 18 inside. The inner conductor accommodation chambers 27 are formed to penetrate through the dielectric 19 in the front-rear direction and be open on a lower surface side.

[Inner Conductors 18]

As shown in FIG. 9, the inner conductor 18 is formed by bending a tab-like metal plate at an intermediate position and includes a straight portion 28 extending along the front-rear direction (direction along a plate surface of the circuit board 50) and a bent portion 29 bent with respect to the straight portion 28 and extending along the vertical direction (direction orthogonal to the plate surface of the circuit board 50).

As shown in FIG. 2, the straight portion 28 can contact the mating inner conductor 71 accommodated in the mating connector 70. The straight portion 28 projects further forward than the dielectric 19. On the other hand, the bent portion 29 is bent downward substantially at a right angle with respect to the straight portion 28, and projects further downward than the lower surface of the connector housing 11. A projecting part of the bent portion 29 from the lower surface of the connector housing 11 is inserted into the inner conductor through hole 52 formed in the circuit board 50 and soldered, thereby being electrically connected to the signal conductive path 53 formed on the circuit board 50.

Next, an example of an assembling procedure of the board connector 10 and the device 60 according to this embodiment is described. The assembling procedure of the board connector 10 and the device 60 is not limited to the one described below.

The inner conductors 18 are inserted into the inner conductor accommodation chambers 27 of the dielectric 19 from behind. Subsequently, the inner conductors 18 are mounted into the outer conductor 20 from behind. In this way, a part of the dielectric 19 extending in the front-rear direction is press-fit into the tubular portion 21 of the outer conductor 20.

Subsequently, the tubular portion 21 of the outer conductor 20 is press-fit into the outer conductor mounting hole 34 of the connector housing 11 from behind. At this time, the locking projections 33 are inserted into the locking recesses 26 of the flange 23. By the above process, the board connector 10 is completed.

Subsequently, the board connector 10 is assembled with the circuit board 50 from above. The board connecting portions 24 are inserted into the outer conductor through holes 51 of the circuit board 50 from above and lower end parts of the bent portions 29 are inserted into the inner conductor through holes 52 of the circuit board 50 from above. Thereafter, the board connecting portions 24 and the lower end parts of the bent portions 29 are respectively fixed to the conductive paths formed on the inner surfaces of the outer conductor through holes 51 and the conductive paths formed on the inner surfaces of the inner conductor through holes 52 by soldering.

The circuit board 50 is fixed to the lower case 61. The upper case 62 is assembled with the lower case 61 from above, and the lower case 61 and the upper case 62 are fixed to form the case 63. At this time, a hole edge part of the lower recess 64 provided in the lower case 61 is brought into contact with the outer surface of the outer conductor 20 and a hole edge part of the upper recess 65 provided in the upper case 62 is brought into contact with the outer surface of the outer conductor 20. In this way, the outer conductor 20 and the case 63 are electrically connected. In the above way, the device 60 is completed.

The mating connector 70 is fit into the receptacle 15 from front. The lock arm 72 is resiliently deformed to resiliently engage the lock portion 31. In this way, the mating connector 70 is retained and held in the connector housing 11. In this state, the inner conductors 18 of the board connector 10 are electrically connected to the mating inner conductors 71 of the mating connector 70. Further, the outer conductor 20 of the board connector 10 is electrically connected to the mating outer conductor 73 of the mating connector 70.

Next, functions and effects of this embodiment are described. The board connector 10 according to this embodiment is the board connector 10 to be mounted on the circuit board 50 and is provided with the connector housing 11 including the receptacle, 15 into which the mating connector 70 is to be fit, and the back wall 30 provided on the side opposite to the opening direction of the receptacle 15, the outer conductor 20 disposed in the outer conductor mounting hole 34 formed to penetrate through the back wall 30, the insulating dielectric 19 disposed inside the outer conductor 20 and the inner conductors 18 disposed inside the dielectric 19, and the outer conductor 20 includes the closing portion 25 for closing the mold removal hole 32 formed at a position of the back wall 30 different from the outer conductor mounting hole 34.

According to the above configuration, the mold removal hole 32 formed in the connector housing 11 is closed by the closing portion 25 of the outer conductor 20. In this way, it is possible to suppress the leakage of noise generated from the signal conductive paths 53 and the ground conductive paths 54 of the circuit board 50 and the electronic component and the like mounted on the circuit board 50 to outside through the mold removal hole 32 of the board connector 10. In this way, the shielding performance of the board connector 10 can be improved.

Further, according to this embodiment, the outer conductor 20 includes the tubular portion 21 extending in the front-rear direction and configured to accommodate at least parts of the inner conductors 18, and the flange 23 projecting outward is provided on the outer periphery of the tubular portion 21 and provided with the closing portion 25.

According to the above configuration, by bringing the flange 23 into contact with the back wall 30 of the connector housing 11, the connector housing 11 and the outer conductor 20 can be easily aligned in the front-rear direction of the receptacle 15.

Further, the mold removal hole 32 of the back wall 30 can be reliably closed by bringing the back wall 30 of the connector housing 11 and the flange 23 into contact.

Further, according to this embodiment, the connector housing 11 and the outer conductor 20 are positioned by fitting the locking projections 23 provided on the back wall 30 and the locking recesses 26 provided in the flange 23.

According to the above configuration, the connector housing 11 and the outer conductor 20 can be reliably positioned.

Further, the device 60 according to this embodiment includes the board connector 10, the circuit board 50 having the board connector 10 mounted thereon, and the case 63 made of metal, configured to accommodate the circuit board 50 and electrically connected to the outer conductor 20.

According to the above configuration, since the case 63 made of metal is electrically connected to the outer conductor 20, the leakage of noise generated from the circuit board 50 accommodated in the case 63 to outside can be reliably suppressed.

Second Embodiment

Figure 10:
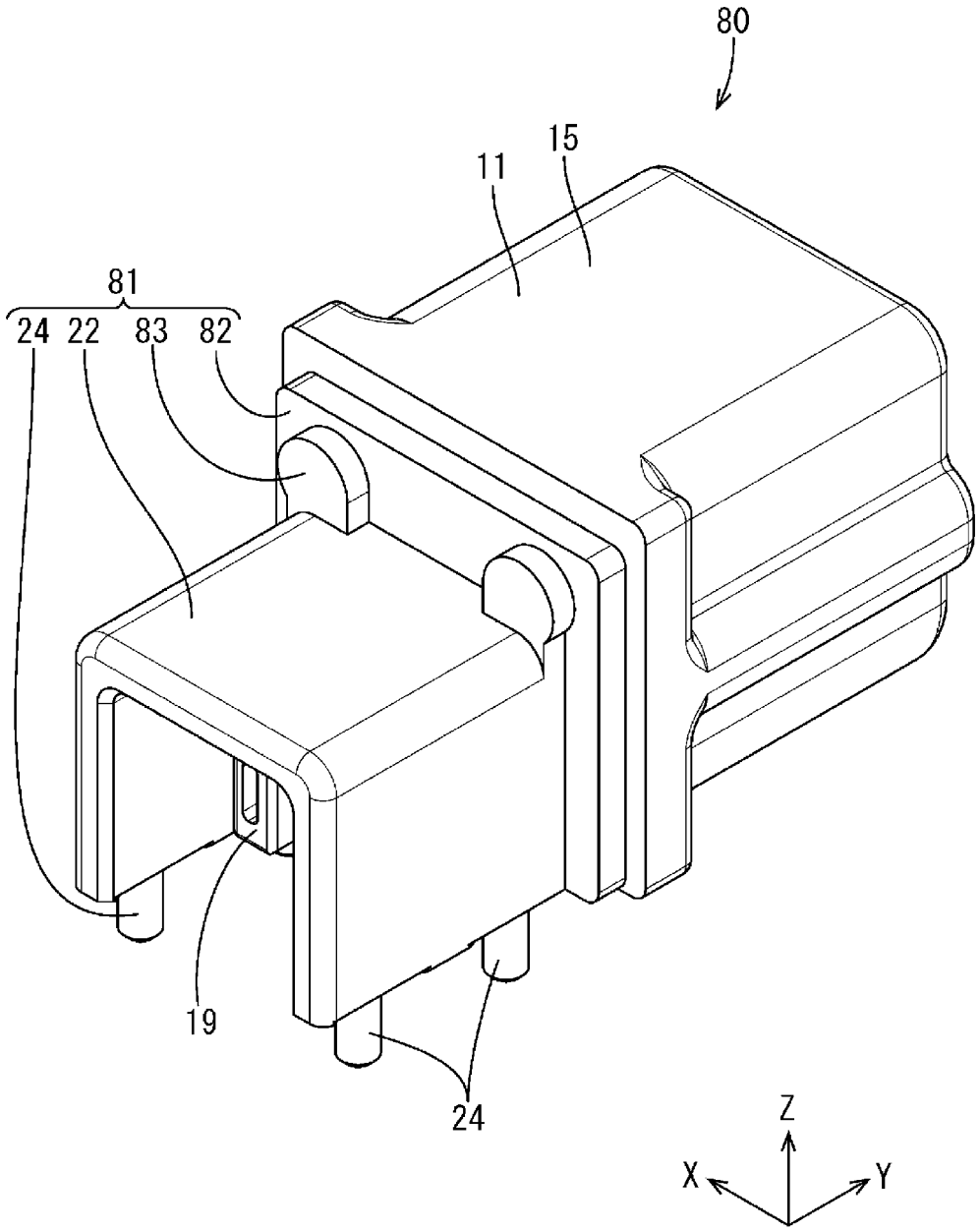
FIG. 10 is a perspective view showing a board connector according to a second embodiment.
Figure 11:
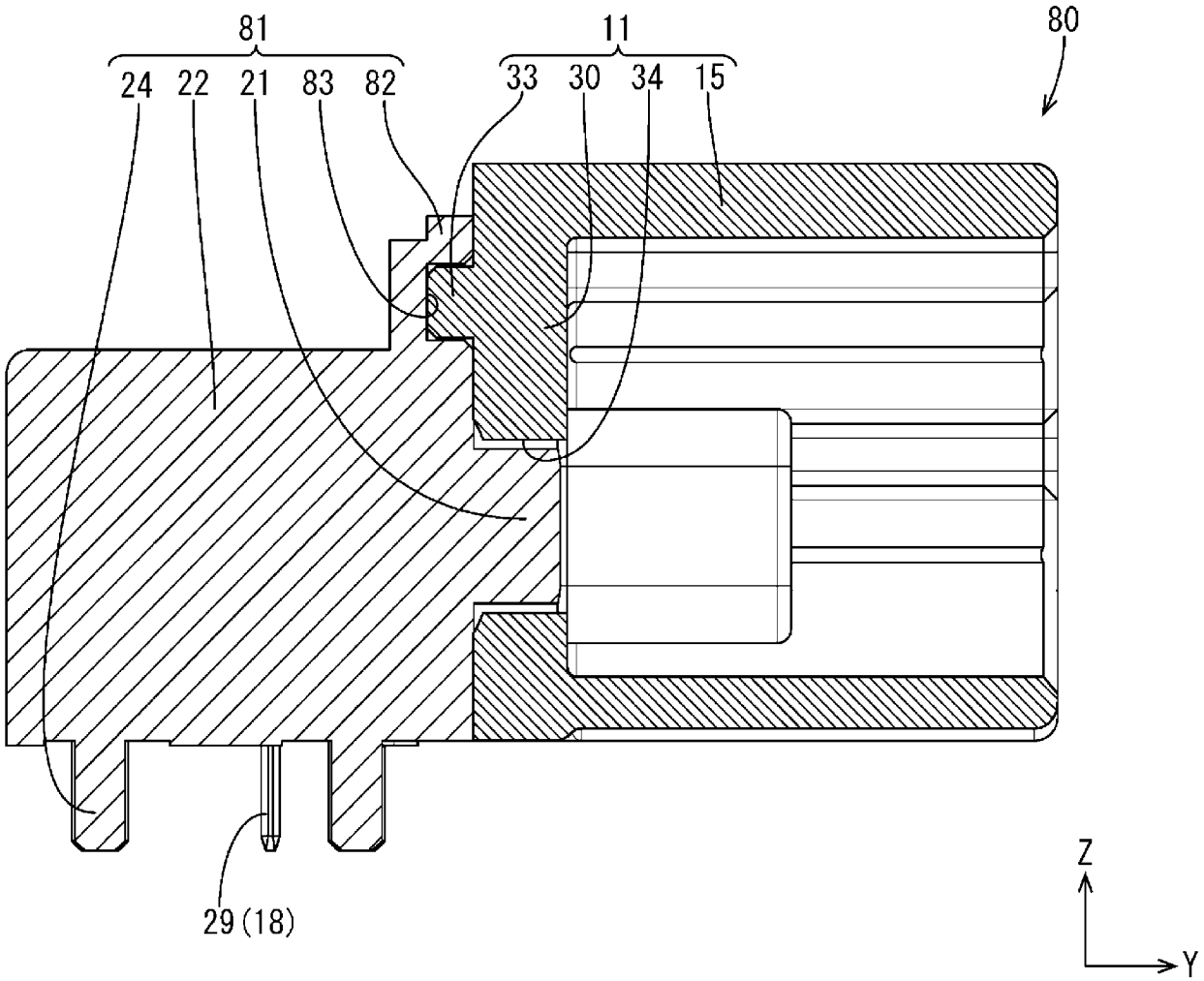
FIG. 11 is a section showing the board connector.

A second embodiment of the technique disclosed in this specification is described with reference to FIGS. 10 and 11. In a board connector 80 according to this second embodiment, locking recesses 83 formed in a flange 82 of an outer conductor 81 are bottomed holes and do not penetrate through the flange 82. In this way, a back wall 30 of a connector housing 11 is not exposed rearward in a part to be contacted from behind by the flange 82, out of the rear surface of the back wall 30.

Since the other configuration is substantially the same as in the first embodiment, the same members are denoted by the same reference signs and repeated description is omitted.

According to this embodiment, noise generated from a circuit board 50 is electromagnetically shielded by the flange 82 of the outer conductor 81, whereby leakage to outside through the back wall 30 of the connector housing 11 is suppressed.

Third Embodiment

Figure 12:
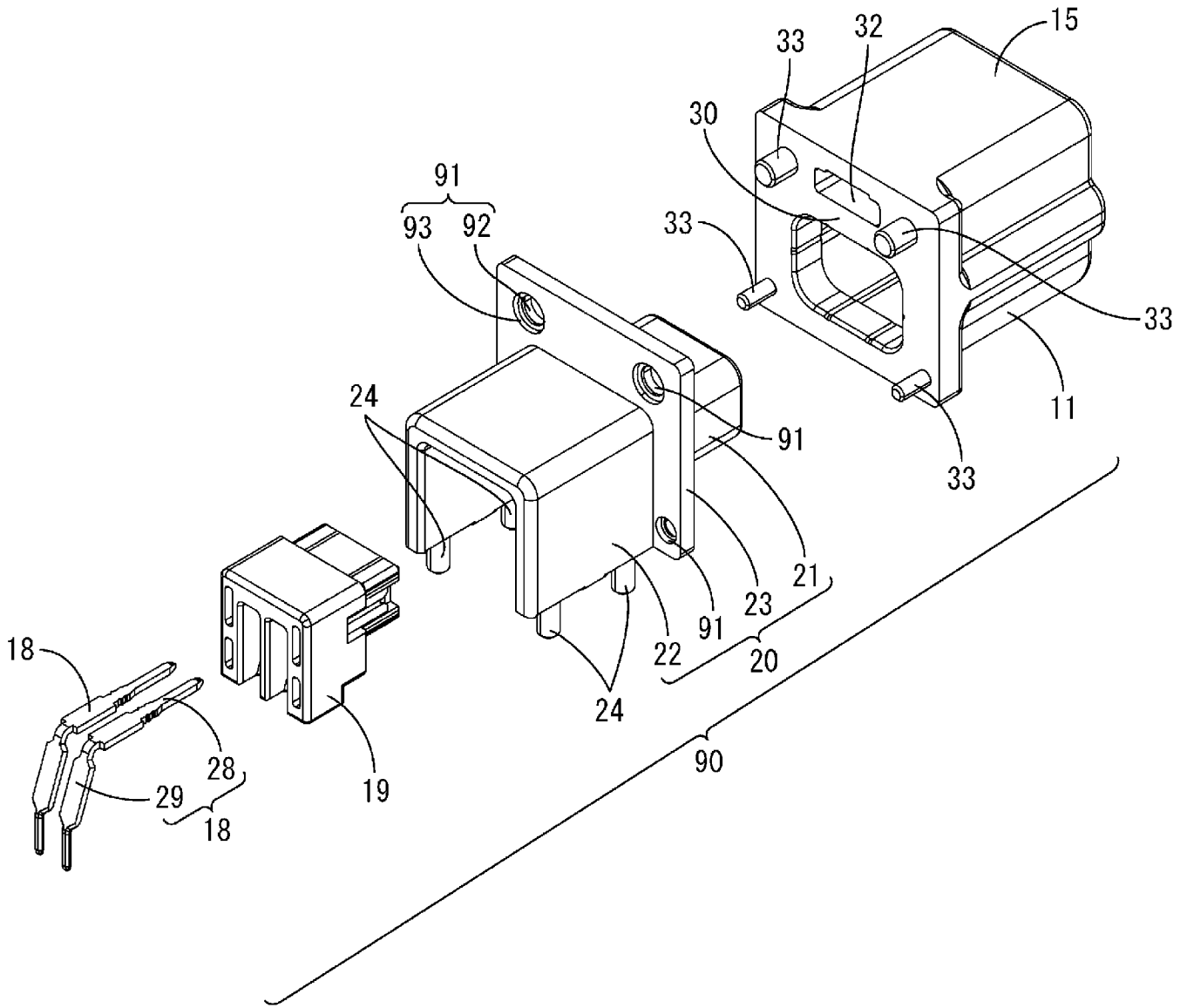
FIG. 12 is an exploded perspective view showing a board connector according to a third embodiment.

A third embodiment of the technique disclosed in this specification is described with reference to FIGS. 12 to 14. As shown in FIG. 12, in a board connector 90 according to the third embodiment, each of locking recesses 91 provided in a flange 23 includes a small-diameter portion 92 located on a front side and a large-diameter portion 93 located on a rear side and having a larger diameter than the small-diameter portion 92.

Figure 13:
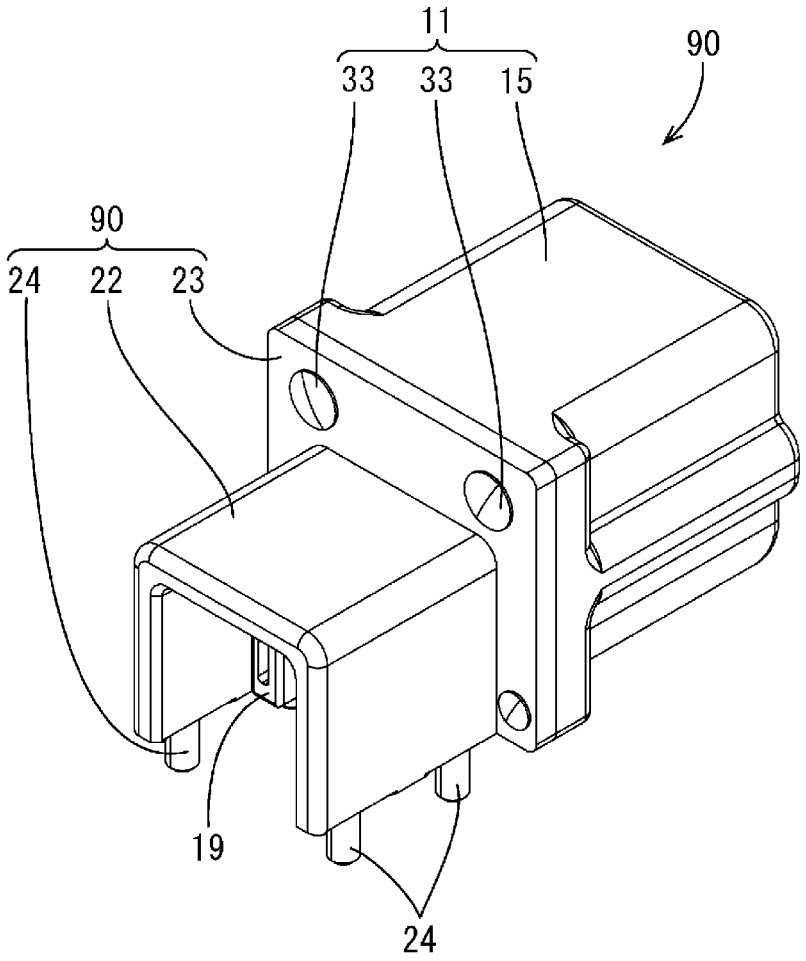
FIG. 13 is a perspective view showing the board connector.

As shown in FIG. 13, locking projections 33 of a connector housing 11 have rear end parts squeezed by heating and pressing while being passed through locking recesses 91 from front to rear.

Figure 14:
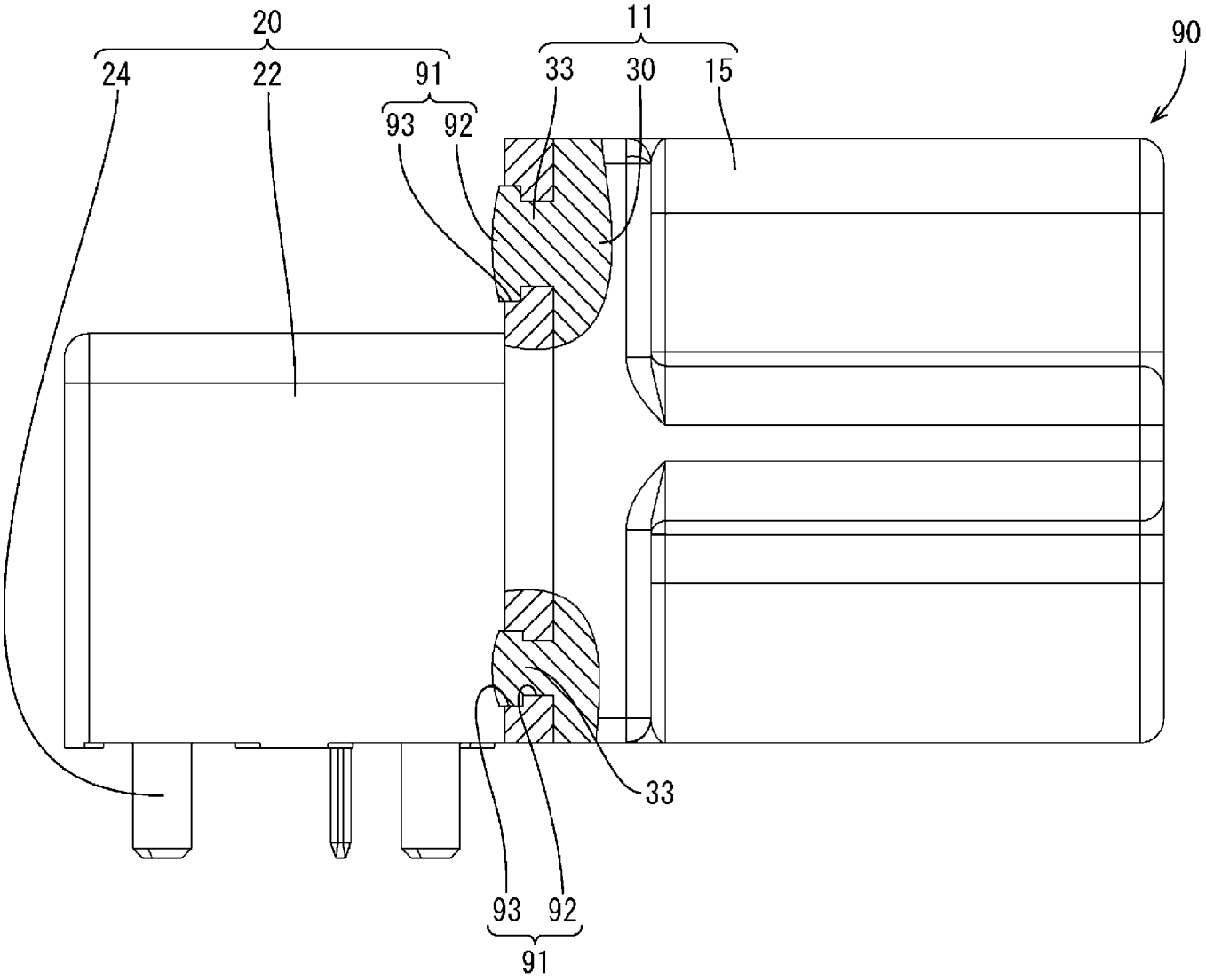
FIG. 14 is a side view of the board connector according to the third embodiment showing cross-sectional shapes of locking projections and locking recesses.

As shown in FIG. 14, the squeezed locking projections 33 are filled in the small-diameter portions 92 formed on the side of the back wall 30 of the connector housing 11 and the large-diameter portions 93 provided on a side opposite to the back wall 30. The locking projections 33 filled in the large-diameter portions 93 contact boundary parts between the small-diameter portions 92 and the large-diameter portions 93 in the flange 23 from behind, whereby the connector housing 11 and the flange 23 are fixed while being positioned in the front-rear direction.

Since the other configuration is substantially the same as in the first embodiment, the same members are denoted by the same reference signs and repeated description is omitted.

According to the above configuration, the squeezed locking projections 33 contact the boundary parts between the large-diameter portions 93 and the small-diameter portions 92 in the locking recesses 91, whereby the connector housing 11 and the flange 23 are fixed. Since the connector housing 11 and the outer conductor 20 can be fixed by a simple method of heat welding, a manufacturing operation of the board connector 90 can be made efficient. Further, since position shifts of the connector housing 11 and the outer conductor 20 can be suppressed, the shielding performance of the board connector 90 can be improved.

Fourth Embodiment

Figure 15:
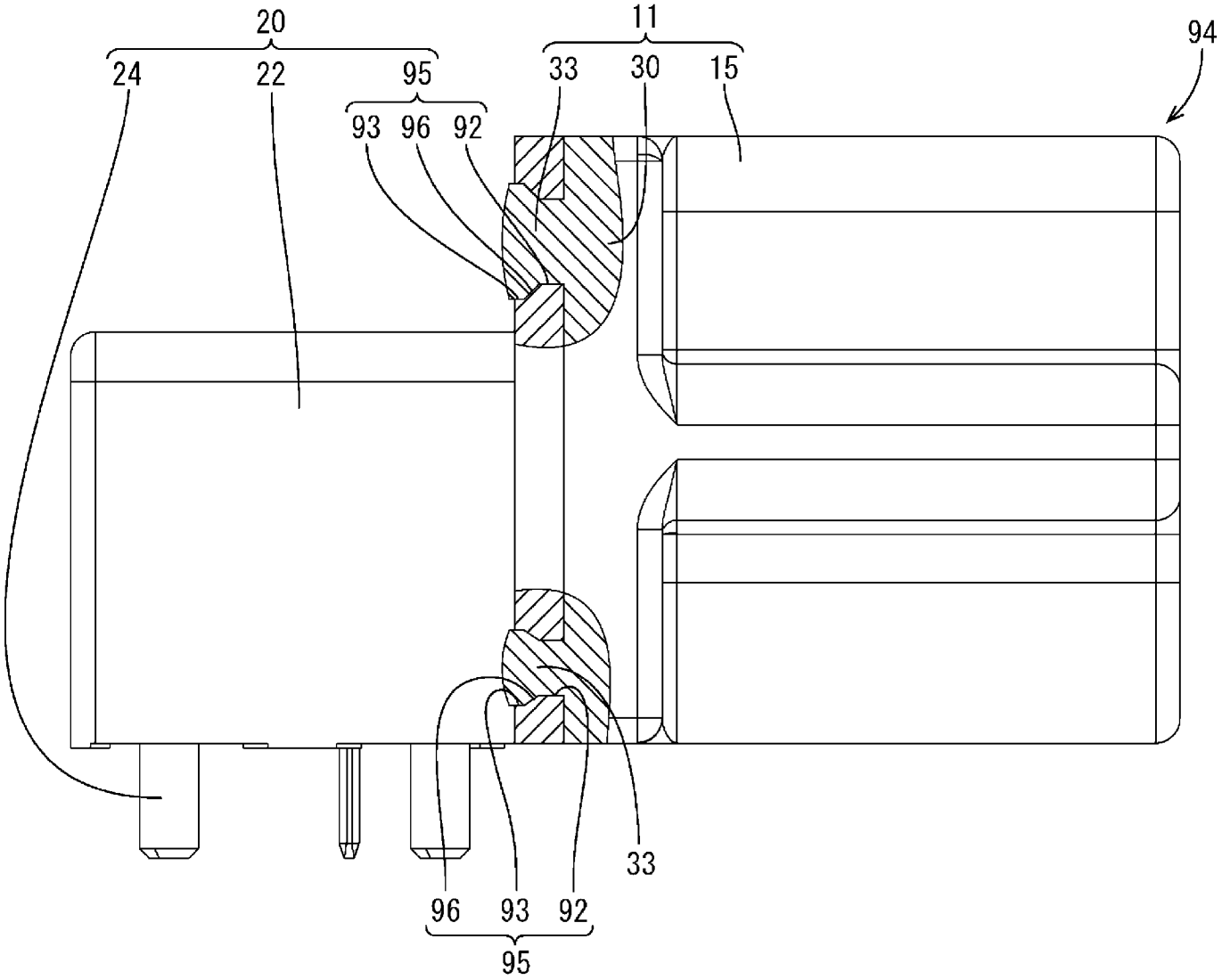
FIG. 15 is a side view of a board connector according to a fourth embodiment showing cross-sectional shapes of locking projections and locking recesses.

A fourth embodiment of the technique disclosed in this specification is described with reference to FIG. 15. In a board connector 94 according to this embodiment, a tapered surface 96 expanded in diameter from front to rear is formed in a front part of a large-diameter portion 93 formed in a locking recess 95. In other words, the tapered surface 96 is formed to be expanded in diameter with distance from a back wall 30 of a connector housing 11.

Locking projections 33 of the connector housing 11 are squeezed by heating and pressing after being passed through the locking recesses 95, and filled in the locking recesses 95.

Since the other configuration is substantially the same as in the first embodiment, the same members are denoted by the same reference signs and repeated description is omitted.

In this embodiment, by forming the tapered surface 96 in the large-diameter portion 93, the melted and squeezed locking projection 33 is more easily held in close contact with the inner wall of the locking recess 95. In this way, the connector housing 11 and an outer conductor 20 can be more firmly fixed.

Fifth Embodiment

Figure 16:
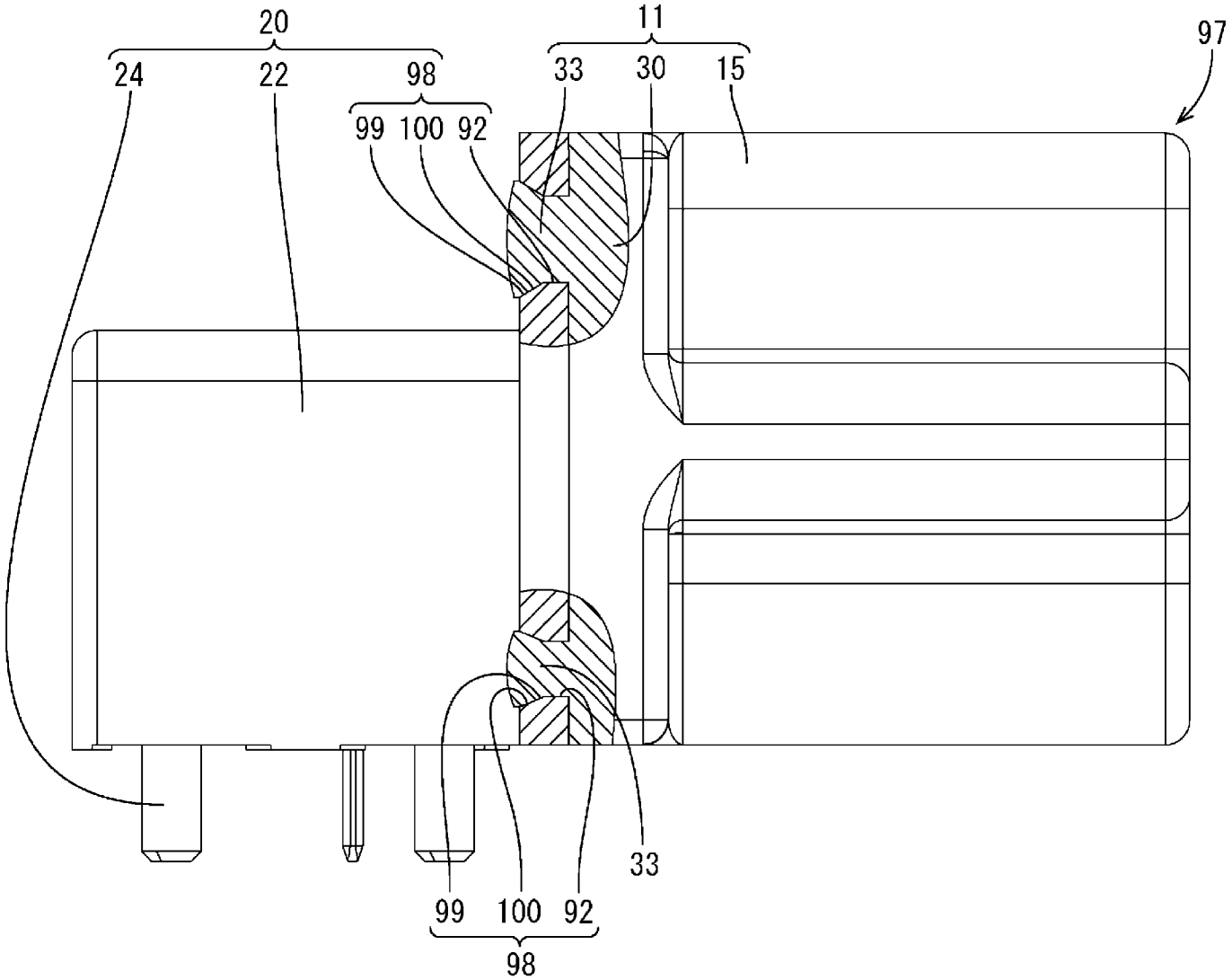
FIG. 16 is a side view of a board connector according to a fifth embodiment showing cross-sectional shapes of locking projections and locking recesses.

Next, a fifth embodiment of the technique disclosed in this specification is described with reference to FIG. 16. In a board connector 97 according to this embodiment, the entire inner surface of a large-diameter portion 99 formed in a locking recess 98 is formed into a tapered surface 100 expanded from front to rear. The tapered surface 100 according to this embodiment is also formed to be expanded in diameter with distance from a back wall 30 of a connector housing 11.

Since the other configuration is substantially the same as in the first embodiment, the same members are denoted by the same reference signs and repeated description is omitted.

According to this embodiment, since the entire inner surface of the large-diameter portion 99 is formed into the tapered surface 100, a melted and squeezed locking projection 33 is more easily held in close contact with the inner wall of the locking recess 98. In this way, the connector housing 11 and an outer conductor 20 can be more firmly fixed.

Other Embodiments

The technique disclosed in this specification is not limited to the above described and illustrated embodiments. For example, the following embodiments are also included in the technical scope of the technique disclosed in this specification.

(1) The locking recesses 26 may be provided in the back wall 30, and the locking projections 33 may be provided on the flange 23. Further, the locking projections 33 and the locking recesses 26 may be omitted.

(2) The case 63 may be made of synthetic resin.

(3) The outer conductor 20 may be formed by press-working a metal plate material.

(4) One, three or more inner conductors 18 may be provided.

(5) The through hole formed in the back wall 30 is not limited to the mold removal hole 32 for injection-molding the lock portion 31 and may be a through hole formed for an arbitrary purpose such as a drainage hole or a vent hole.

(6) The closing portion 25 may be provided in a part of the connector housing 11 other than the flange 23.

(7) One, three or more locking projections 33 may be provided. An outer conductor is provided with as many locking recess(es) as the locking projection(s) 33.

LIST OF REFERENCE NUMERALS

10, 80, 90, 94, 97: board connector
11: connector housing
15: receptacle
18: inner conductor
19: dielectric
20, 81: outer conductor
21: tubular portion
22: dielectric surrounding portion
23, 82: flange
24: board connecting portion
25: closing portion
26, 83, 91, 95, 98: locking recess
27: inner conductor accommodation chamber
28: straight portion
29: bent portion
30: back wall
31: lock portion
32: mold removal hole (example of through hole)
33: locking projection
34: outer conductor mounting hole
50: circuit board
51: outer conductor through hole
52: inner conductor through hole
53: signal conductive path
54: ground conductive path
60: device
61: lower case
62: upper case
63: case
64: lower recess
65: upper recess
70: mating connector
71: mating inner conductor
72: lock arm
73: mating outer conductor
92: small-diameter portion
93, 99: large-diameter portion
96, 100: tapered surface

What is claimed is:

1. A board connector to be mounted on a circuit board, comprising:

a connector housing including a receptacle having an opening facing a front direction and a back wall facing a rear direction and provided on a side opposite to the opening of the receptacle, the back wall including an outer conductor mounting hole and a through hole;

a mating connector configured to fit into the receptacle;

an outer conductor inserted in the outer conductor mounting hole to penetrate through the back wall;

an insulating dielectric disposed inside the outer conductor; and an inner conductor disposed inside the dielectric, wherein the outer conductor includes a flange configured to contact the back wall, the flange including a closing portion for closing the through hole, the through hole being formed at a position of the back wall different from the outer conductor mounting hole.

2. The board connector of claim 1, wherein:

the outer conductor includes a tubular portion extending in the front direction and configured to accommodate at least a part of the inner conductor, and the flange is provided on an outer periphery of the tubular portion.

3. The board connector of claim 2, wherein the connector housing and the outer conductor are positioned by fitting a locking projection provided on one of the back wall and the flange and a locking recess provided in the other.

4. The board connector of claim 3, wherein:

the locking recess is provided in the flange, the locking recess includes a small-diameter portion on the back wall side and a large-diameter portion provided on a side opposite to the back wall and having a larger diameter than the small-diameter portion, and the locking projection is filled in the locking recess.

5. The board connector of claim 4, wherein the large-diameter portion has a tapered surface expanded in diameter with distance from the back wall.

6. A device, comprising:

the board connector of claim 1;

a circuit board having the board connector mounted thereon; and a case made of metal for accommodating the circuit board, the case being electrically connected to the outer conductor.

* * * * *